US006736136B2

(12) United States Patent
Chen-Lieh

(10) Patent No.: US 6,736,136 B2
(45) Date of Patent: May 18, 2004

(54) SNORKEL FIXTURE OF SWIMMING MASK

(75) Inventor: Pan Chen-Lieh, Ilan Hsing (TW)

(73) Assignee: QDS Injection Molding LLC, San Diego, CA (US)

( * ) Notice: Subject to any disclaimer, the term of this patent is extended or adjusted under 35 U.S.C. 154(b) by 0 days.

(21) Appl. No.: 10/265,152

(22) Filed: Oct. 7, 2002

(65) Prior Publication Data

US 2004/0003809 A1 Jan. 8, 2004

(30) Foreign Application Priority Data

Jul. 2, 2002 (TW) ..... 91210020 U

(51) Int. Cl.[7] ..... B63C 11/16; A44B 21/00

(52) U.S. Cl. ..... 128/201.11; 128/201.26; 24/3.11

(58) Field of Search ..... 128/200.24, 201.11, 128/201.26, 201.27, 201.28, 202.27, 206.29, 200.29; 405/186, 187; 24/455, 457, 458, 489, 369, 336, 339, 486, 305, 3.13, 3.11, 3.12, 704.1, 572.1, 573.09; 248/122.1, 125.1, 125.3, 297.31, 226.11, 316.1

(56) References Cited

U.S. PATENT DOCUMENTS 4,907,582 A * 3/1990 Meyerrose ..... 128/201.11
5,730,342 A * 3/1998 Tien ..... 224/271
5,839,173 A * 11/1998 Otrusina ..... 24/595.1
5,855,044 A * 1/1999 Cradduck ..... 24/20 R
D406,333 S * 3/1999 Garraffa ..... D24/110.5
5,906,199 A * 5/1999 Budzinski ..... 128/201.11
6,006,969 A * 12/1999 Kim ..... 224/197
6,073,626 A * 6/2000 Riffe ..... 128/201.11
6,129,081 A * 10/2000 Wu ..... 128/201.11
6,222,728 B1 * 4/2001 Jaggers et al. ..... 361/686
6,283,348 B1 * 9/2001 Wang ..... 224/271
6,299,041 B1 * 10/2001 Pitisi et al. ..... 224/271
6,302,102 B1 * 10/2001 Giroux et al. ..... 128/201.11
6,311,881 B1 * 11/2001 Kamiya ..... 224/195
6,342,138 B1 * 1/2002 Brown ..... 204/297.09
6,352,075 B1 * 3/2002 Wang ..... 128/201.11
6,363,929 B1 * 4/2002 Winefordner et al. . 128/201.11
6,438,808 B1 * 8/2002 Kung ..... 24/572.1
6,464,188 B1 * 10/2002 Donovan ..... 248/316.1
2003/0029976 A1 * 2/2003 Saitoh et al. ..... 248/226.11

* cited by examiner

*Primary Examiner*—Aaron J. Lewis
*Assistant Examiner*—Teena Mitchell
(74) *Attorney, Agent, or Firm*—Troxell Law Office PLLC

(57) ABSTRACT

A snorkel fixture of swimming mask, it provides a function that allows the user to easily separate the snorkel and the mask, a concaving buckle with a round hole is placed on the snorkel, also an attaching and releasing structure is build to slide into the hole on the concaving buckle to attach on the snorkel. By the chain reaction between the embodiment and allow the buckle to contract, the user can remove the buckle body. The snorkel and the mask can be easily attached and released.

3 Claims, 4 Drawing Sheets

A-A Sec.

B-B Sec.

SNORKEL FIXTURE OF SWIMMING MASK

FIELD OF THE INVENTION

The present invention relates to a structure that allows a diving use snorkel to attach on the mask. By using this structure to attach the snorkel to the mask, this structure provides easy, fast and simple methods.

BACKGROUND OF THE INVENTION

Usually divers (or scuba divers) carry masks and snorkels as basic equipments. The snorkel is usually attached to the side of the mask by using a fixture. This fixture hangs on the strap, so the snorkel can be naturally adjust to the correct direction. (Snorkels have to be vertical during usage)

From past experiences, snorkels usually have hook shape equipments to allow itself attach to the strap. Although these structures are simple to use, they also have some odds, such as:

1. Hard to attach: When the snorkel is tightly attached to the strap, it is often hard to adjust the snorkel to a more comfortable and correct position, which is also hard to move.
2. Hard to release: Divers often release the mouth pads from their mouths, or even they sometimes need to release the snorkel from the strap. However, from past experiences, these structures are often hard the release.
3. If the snorkel is not in vertical direction while using it, these hook shape equipments may twist the strap and cause the users to feel uncomfortable.

An ideal fixture of snorkel should at least contain the following function:

1. Easy to attach and release;
2. While adjusting the angle of the snorkel, strap should not be twisted;
3. Easy to adjust the position of the fixture;
4. Easy to produce and assemble.

SUMMARY OF THE INVENTION

The present invention of fixture mainly includes the first part which is assembled on the strap, and the second part which is assembled on the snorkel. These two parts combining together make a fixture structure which contains the cons introduced above. The first part has a structure that allows it to attach and release from the strap. The present invention has this part controlled by a buckle. By functioning with the concaving brick structure of the second part, the attaching and releasing functions can be produced.

Further on, when the user wants the concaving buckle of the second part to attach and release from the first part, the concaving buckle has to be place to a correct position. The present invention has the neck of the concaving buckle designed in difference thickness, so that only in a certain direction the concaving buckle can enter the opening of the first part. On the other hand, by using this method, the concaving buckle would not be released accidentally.

In other words, by using the fixture structure of the present invention, the user can quickly attach the snorkel to the mask in certain direction. When attached, the mouth pad of the snorkel can easily be adjusted to the most appropriate position where the user's mouth is. If the user would like to release the snorkel, he/she only has to press on the pressing board of the structure, and the snorkel can be released quickly in a certain direction.

Since both parts are designed to allow the snorkel to do horizontal and vertical adjustment, the snorkel and the strap can be adjusted to the most comfortable position for the user.

According to the spirit of patent law, the description of the fixture structure of the present invention can be modified according to the different specialties. For example, the way the first part and the second part attach to the mask and the snorkel, or by switching each other, or by some modification of the structure of the fixture should all be included in this case.

The main purpose of the present invention is to produce fixture equipment that allows the snorkel to quickly attach or release from the mask.

The present fixture structure includes the first part and the second part; where the first part can be adjust horizontally on the strap by not twisting the strap. The second part is located on the snorkel and can move in vertical direction. By combining the two functions, the snorkel can be adjusted to the most comfortable position for the diver.

DETAILED DESCRIPTION OF THE PERFERRED EMBODIMENTS

Figure 1:
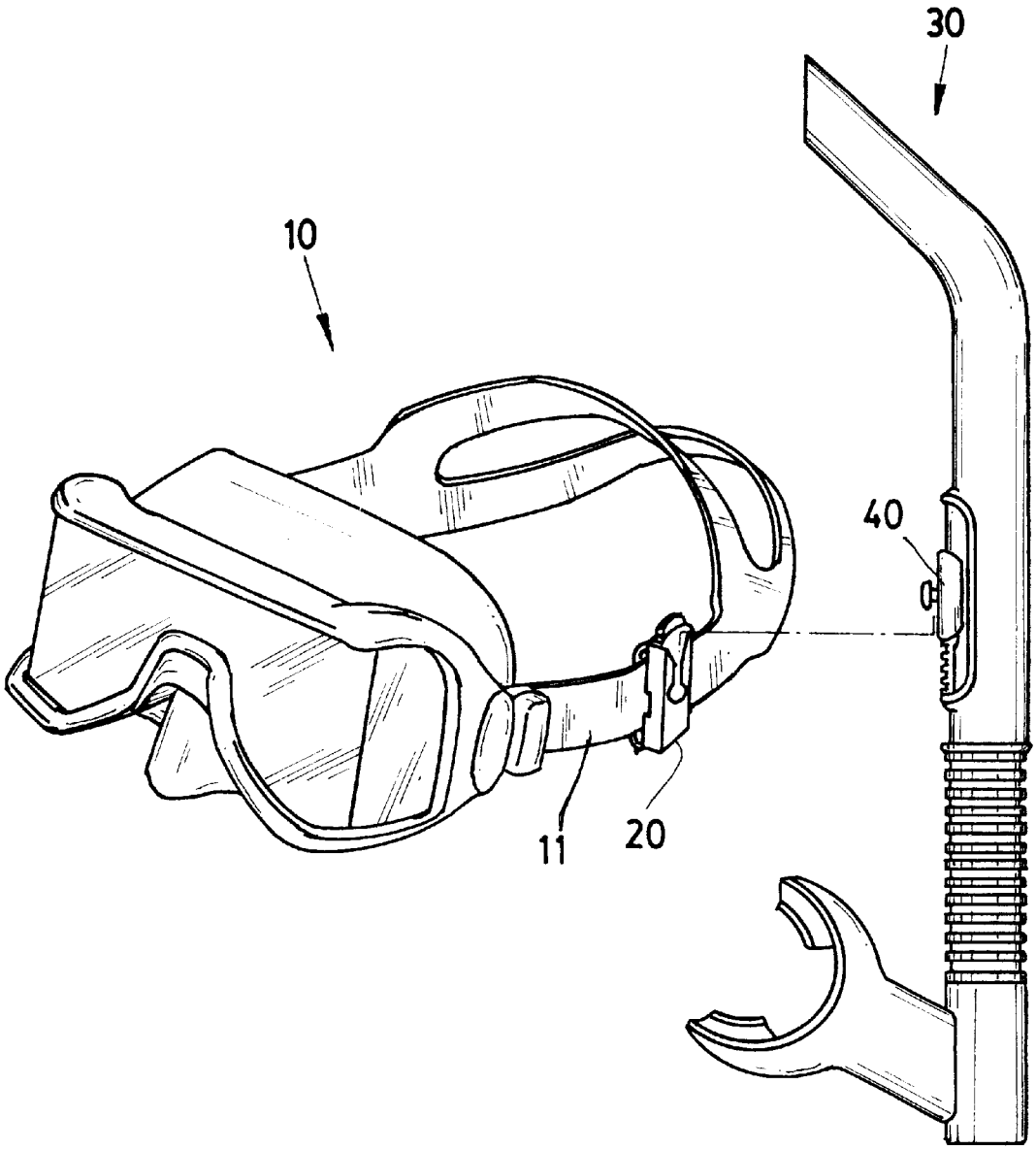
FIG. 1 is an isometric view of the present invention.

Referring to FIG. 1, the present invention is an assembled by two parts, which includes the first part 20 that locates on the mask 10 and the strap 11, also the second part 40 that locates on the snorkel 30.

Figure 2:
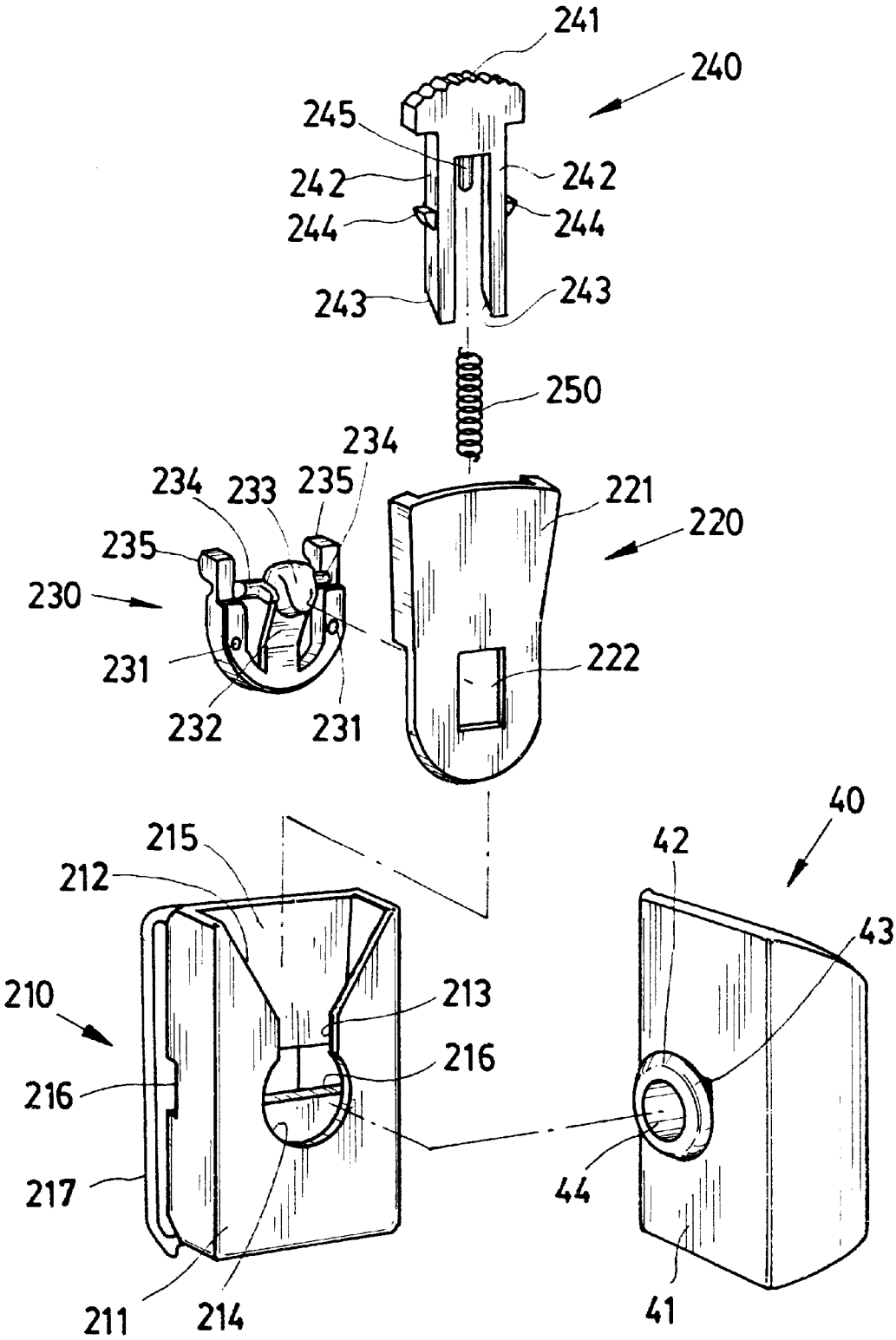
FIG. 2 is an exploded view of the present invention.

Referring to FIG. 2, the first part 20 includes a main embodiment 210, an applying board 220, a clicking board 230, a pressing board 240, and a spring 250. The second part 40 includes a flat board 41, a concaving buckle42, and a neck 43; an inner round hole 44 is located at the center of the concaving buckle 42.

The main embodiment 210 has a cube part 211, and a hook board 217. The cube part 211 has an opening 212 at the front, a limited opening 213 and a round whole 214. The cube part 211 has a space 215 inside; the cube part 211 has a stock well on the back surface. A hook board 217 is located at the back of the cube part 211, which is used to hook itself on the strap 11, in order to move horizontally on the strap 11.

Figure 3:
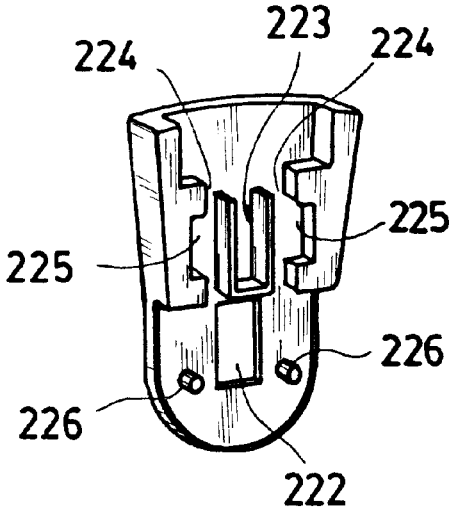
FIG. 3 is a reverse isometric view of the applying board.

The applying board 220 is a board that can be inserted into the space 215. Referring to FIGS. 2 and 3, its structure includes a flat surface 221, a window 222, a spring box 223, paths 224 on the two sides of the spring box 223, wells 225 on the outer part of the path 224, and concaving joints 226 on the two sides of the window 222.

The clicking board 230 is locate below the applying board 220, which includes two holes 231, a spring board 232, a buckle 233 above the spring board 232, two side wings 234 on the two sides of the buckle 233, and buckle bodies 235 at the two sides of the clicking board 230.

The pressing board 240 contains a pressing part 241, sliding piece 242 on the two sides, restricting slopes 243 below the two sliding pieces 242, bricks 244 on the two sides of the sliding piece 242, and a concaving stick 245 between the two sliding pieces 242.

The spring 250 is located between the spring box 223 and the concaving stick 245.

Figure 4:
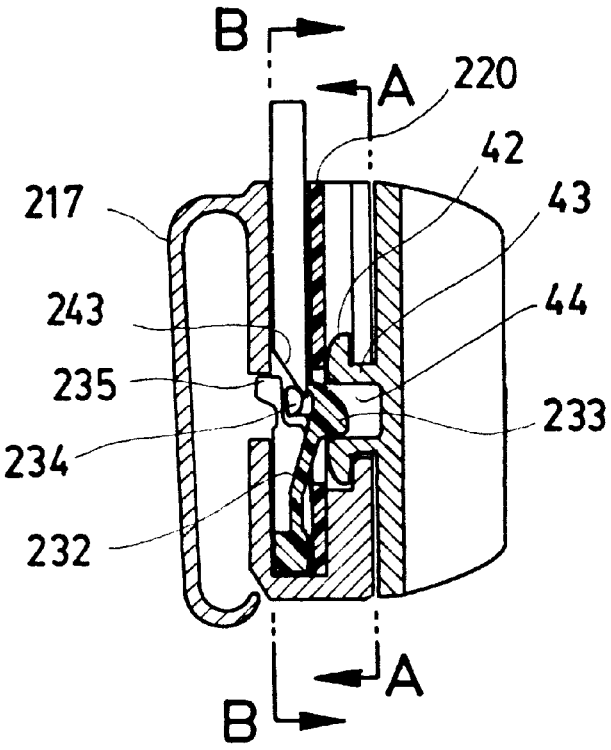
FIG. 4 is an assembled dissects view of the first part and the second part.

Please view the FIGS. 4 to 7 for the follow descriptions. There are recovering springs 250 located inside the spring box 223. Also, the sliding piece 242 of the pressing board 240 is located at the path 224, so that the brick 244 is located inside the well 225. This way, the pressing board 240 can move vertically. By using this vertical movement, the recovering spring 250 can automatically recover by itself. However, it is stock in the well because of the brick 244. By combining the concaving joint 226 and the hole 231, the clicking board 230 is fixed at the applying board 220, the buckle 233 comes out from the window 222. Referring to FIG. 4, after the applying board 220 is inserted into the main embodiment 210, the two buckle body 235 is stock in the stock well 216, so that the applying board 220 is fixed in the main embodiment 210. The position of the buckle 233 is inside the inner round hole 44.

The second part 40 has its concaving buckle 42 enter the round hole 214 by going through the opening 212, and the limited opening 213. The buckle 233 contracts because the concaving buckle 42 is being pressed by external forces. When the concaving buckle 42 move to the assigned position, the inner round hole 44 of the concaving buckle 42 make the buckle 233 recover to the original position. (Referring to FIG. 4) This time, the second part 40 would be locked and not being able to exit.

Figure 5:
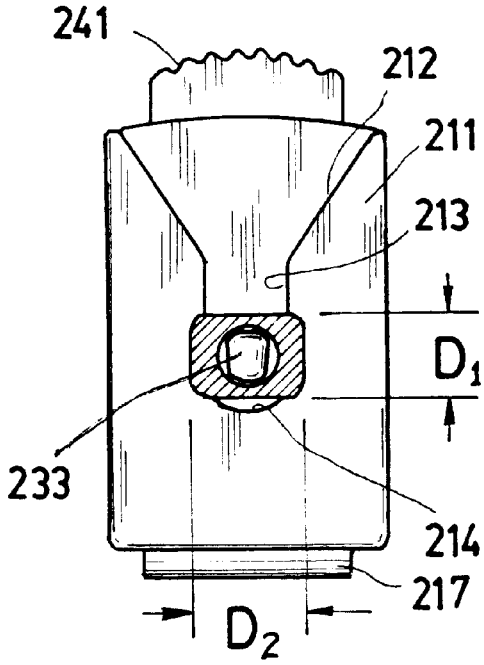
FIG. 5 is a sectional view A—A of FIG. 4.
Figure 6:
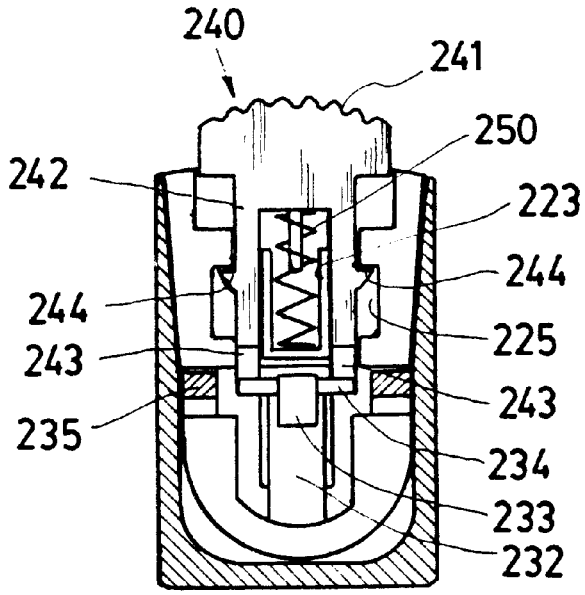
FIG. 6 is a sectional view B—B of FIG. 4.

Referring to FIG. 5, the neck 43 can further on designed in two different thicknesses $D_1$ and $D_2$. $D_1$ is smaller than the limited opening 213, and $D_2$ is larger than the limited opening 213. When the second part 40 needs to exit the first part 20, the buckle 233 not only has to exit the inner round hole 44, since $D_2$ is larger than the limited opening 213, the part has to be exit from the direction of $D_1$.

Figure 7:
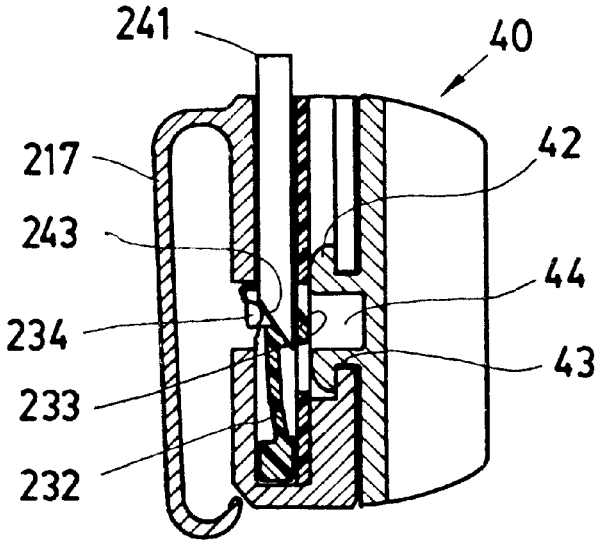
FIG. 7 is an assembled dissects view of the first part and the second part. (Press board pressed)

Referring to FIG. 7, when the pressing part 241 is pressing downwards, the limited slope 243 will force the side wings 234 moving backwards, further on the side wings 234 will also take the buckle 233 to move backwards to exit the inner round hole 44. Because of the previous movements, the second part 40 can exit the first part 20 upwards in a certain direction.

According to all the description above, the snorkel's fixture structure of the present invention provides a second part 40 to quickly insert into the first part 20. While exiting, the user only has to press the pressing part 241, make the $D_1$, direction pointing to the limited opening 213, and lift upward. In other words, the present invention's snorkel 30 can quickly attach and release from-the mask 10.

What is claimed is:

1. A snorkel fixture of a swimming mask comprising first and second parts that are combinable:

a) the first part configured to be attached to a swimming mask and including:

i) a body having a cube part and a hook board, an opening, a limited opening and a round hole structure is constructed at a front of the cube part, a space is inside the cube part, and a stock well is located on a back of a flat surface of the cube part;

ii) a hook board is located on a back of the cube part;

iii) an applying board is inserted into the space and includes a surface, a window and a spring box, the spring box has paths on two sides, and wells are located on two outer parts of the paths, concaving joints are located on two sides of the window;

iv) a pressing board having a pressing part, two side sliding pieces located on two sides thereof, restricting slopes located below the two sliding pieces, bricks located on two sides of the two sliding pieces and a concaving stick is located between the two sliding pieces;

v) a clicking board located between the back of the cube part and the applying board, the clicking board has two holes, a spring board, buckle part connected to the spring board, two side wings on two sides of the buckle part, and buckles at outer two sides of the clicking board; and vi) a spring located between the spring box and the concaving stick; and b) the second part configured to be attached to a snorkel and including a concaving buckle with a neck, and an inner round hole inside the buckle, whereby the second part releasably engages the first part by insertion of the concaving buckle through the round hole and the pressing board urges the buckle part into engagement with the inner round hole of the second part.

2. The snorkel fixture of swimming mask recited in claim 1, wherein the neck of the concaving buckle has a thickness smaller than a width of the opening.

3. The snorkel fixture of swimming mask recited in claim 1, wherein the bricks of the sliding pieces are located in the wells of the applying board.

* * * * *